United States Patent [19]

Wrzalinski

[11] Patent Number: 4,596,726

[45] Date of Patent: Jun. 24, 1986

[54] MULTIPLE HOOP ORNAMENT WITH INTERIOR FABRIC DESIGN

[75] Inventor: Frank V. Wrzalinski, Morgantown, Ind.

[73] Assignee: Patricia Fashions Incorporated, Morgantown, Ind.

[21] Appl. No.: 700,527

[22] Filed: Feb. 11, 1985

[51] Int. Cl.[4] ..... A47G 33/08; B44F 7/00

[52] U.S. Cl. ..... 428/11; 428/12; 428/14; 428/102

[58] Field of Search ..... 428/11, 45, 542.2, 542.6, 428/12, 14, 102

[56] References Cited

U.S. PATENT DOCUMENTS

| | | | |
|---|---|---|---|
| 424,916 | 4/1890 | Wilmsen | 428/10 |
| 1,329,615 | 2/1920 | Langfelder | 428/11 |
| 1,695,307 | 12/1928 | Wilson | 428/7 X |
| 2,067,527 | 1/1937 | Greene | 428/8 |
| 3,549,465 | 12/1970 | Skelley, Jr. | 428/11 |
| 3,822,171 | 7/1974 | Bouillot | 428/24 X |
| 4,006,540 | 2/1977 | Lemelson | 428/542.6 X |
| 4,214,023 | 7/1980 | Day | 428/11 |

*Primary Examiner*—Henry F. Epstein

*Attorney, Agent, or Firm*—Woodard, Weikart, Emhardt & Naughton

[57] ABSTRACT

An ornament including a plurality of hoops having fabric mounted therein. The hoops are arranged so that the plane of each hoop intersects the plane of the remaining hoops. Various embodiments are disclosed wherein the external geometric configuration of the hoops and the quantity of hoops is varied. Further, a variety of fabric patterns are attached to the hoops. In one embodiment, two pieces of fabric are joined together at their centerline with the centerline the being positioned in line with the inner intersection of two hoops. The outer edge of one fabric is then attached to a hoop while extending through the plane of the hoop to the intersection hoop line and then outwardly with the opposite edges of the fabric attached to the remaining hoop. The second fabric is attached in like fashion to the two remaining portions of the hoops not having fabric attached thereto.

19 Claims, 10 Drawing Figures

MULTIPLE HOOP ORNAMENT WITH INTERIOR FABRIC DESIGN

BACKGROUND OF THE INVENTION

1. Field of the Invention:

This invention is in the field of ornaments both hanging and those placed on a pedestal.

2. Description of the Prior Art:

A variety of ornaments have been designed wherein a fabric design is mounted within a single hoop. Typically, the fabric design will show a variety of cluster or star patterns with the tips of the star being attached at different locations around the circumference of the hoop. As such, it is possible to literally provide thousands of different patterns mounted within a single hoop so that no two ornaments are alike. Further, ornaments are available which incorporate multiple rings or hoops; however, when such multiple hoops are employed, it is not known how to attach fabric designs within the hoops. Disclosed herein is a fabric design construction mounted within a plurality of hoops providing a unique and different ornament.

A number of United States Patents have been granted on various ornaments some of which include a hoop having a design mounted therein such as shown in U.S. Pat. No. 424,916 issued to Wilmsen. A number of patterns have also been designed to provide different ornaments typically utilized with Christmas trees such as shown in U.S. Pat. Nos. 1,329,615 issued to Langfelder U.S. Pat. No. 2,067,527 issued to Greene and U.S. Pat. No. 1,695,307 issued to Wilson. Despite the many ornaments known and utilized, there is still need for further ornaments which are pleasing to the eye and which may be economically manufactured. Disclosed herein is such an ornament.

Many of the prior ornaments are particularly fragile and thus are difficult to store. Further, many ornaments will not collapse and require inordinate storage space due to the many arms or projections built into the ornament. Thus, multiple hoop ornaments having fabric designs mounted therein have not previously been utilized particularly in view of the storage requirements required for such an ornament. Disclosed herein is a multiple hoop ornament which will collapse in a relatively flat condition for storage purposes.

SUMMARY OF THE INVENTION

One embodiment of the present invention is an ornament comprising a plurality of hoops each located within separate planes with each hoop arranged with respect to another hoop so the planes intersect along a line extending interiorly across each of the hoops and fabric means having multiple sheet configured wings joined together along the line with the wings having outer edges attached at separate locations along the hoops and being arranged so each wing extends from a hoop to which it is attached to the line while being located in the respective plane of the hoop to which it is attached.

A further embodiment of the present invention is an ornament comprising a first hoop defining a first plane in which the hoop is located, a second hoop defining a second plane in which the second hoop is located, the second hoop being arranged with respect to the first hoop so the second plane intersects the first plane along a line extending between different points on the second hoop, a first fabric having a first outer edge attached to the first hoop and then extending in the first plane to the line whereat the first fabric extends into the second plane toward the second hoop having the outer edge attached thereto and additional fabric attached to the first fabric along the line and being located in the first plane having an additional edge attached to the first hoop at a location diagonally opposite from the attachment of the first fabric to the first hoop.

It is an object of the present invention to provide a new and improved ornament.

Yet another object of the present invention is to provide an ornament having multiple hoops with a fabric design mounted to and within the hoops.

In addition, it is an object of the present invention to provide a multiple hoop ornament which will collapse for storing and which may be easily extended when utilized.

Related objects and advantages of the present invention will be apparent from the following description.

DESCRIPTION OF THE PREFERRED EMBODIMENTS

Figure 1:
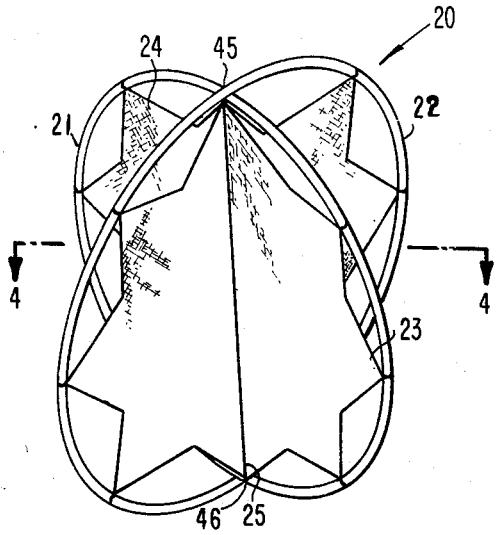
FIG. 1 is a perspective view of a two hoop ornament incorporating a multi-wing fabric design mounted therein.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
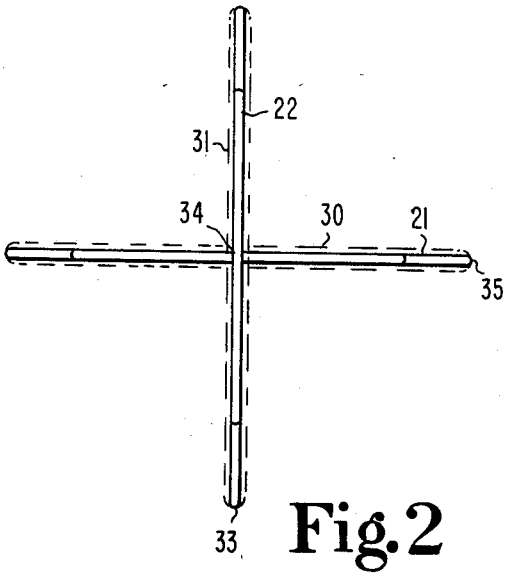
FIG. 2 is a top view of the ornament of FIG. 1.

Referring now more particularly to FIG. 1, there is shown an ornament 20 including a first hoop 21 and a second hoop 22 arranged perpendicularly as shown in FIG. 2. Two pieces of fabric 23 and 24 are mounted to hoops 21 and 22 and extend through the plane of each hoop.

Figure 7:
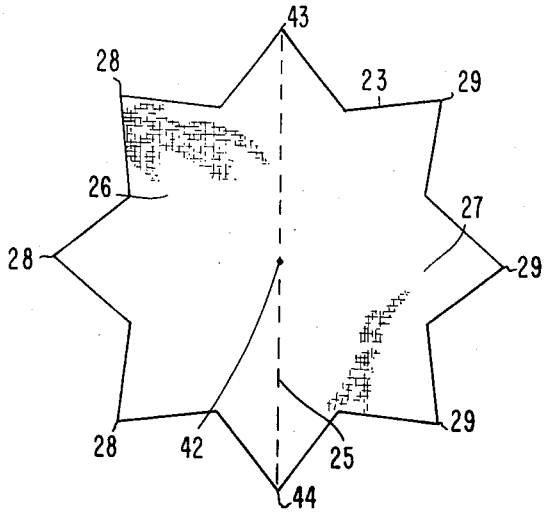
FIG. 7 is a plan view of fabric 23 which is mounted to hoops 21 and 22.

Fabric 23 will now be described it being understood that a similar description applies to fabric 24. Fabric 23 is a single thin sheet of woven, crocheted or other type of fabric or cloth. In the design depicted in the drawings, fabric 23 (FIG. 7) has an external configuration in the form of an eight sided star. The centerline 25 of the fabric divides the design into a lefthand portion 26 and righthand portion 27. Tips 28 of the lefthand portion 26 of fabric 23 are tied by strings to the aft half of hoop 21 (FIG. 1) whereas tips 29 of the righthand portion 27 of fabric 23 are tied by string to the forward half of hoop 22 (FIG. 1). The lefthand portion 26 is bent at a right angle along the line 25 relative to the righthand portion 27 to allow the fabric to extend through the planes of hoops 22 and 21.

Hoop 21 extends through a plane 30 (FIG. 2) whereas hoop 22 extends through plane 32 with planes 30 and 31 intersecting at the midpoint of each hoop. Thus, one half of each hoop is arranged at a 90° angle relative to one-half of the other hoop. Further, hoop 21 is slightly smaller in outside diameter than hoop 22. Alternatively, hoop 21 is forced into and is slightly deformed to fit in hoop 22.

Lefthand portion 26 of fabric 23 extends from end 36 (FIG. 4) of hoop 21 to the midpoint intersection 34 of the hoops with the fabric then being bent at a 90° angle along line 25 at midpoint 34 and extending through plane 31 (FIG. 2) being tied to end 33 of hoop 22. Likewise, fabric 24 being identical to fabric 23 is attached by string to end 35 (FIG. 2) of hoop 21 with the fabric then extending through the plane 30 of hoop 21 to the intersection 34 of the hoops whereat the fabric is bent at a right angle along its centerline and extends back through plane 31 of hoop 22 with the tips of the fabric then being attached by string to the end 37 (FIG. 4) of hoop 22. When attaching the various tips of fabrics 23 and 24, it is best to first wet the string used to tie the fabric tips to the ring and to then apply a flowable substance such as fingernail polish or lacquer to the string knots of each tip allowing the lacquer to then harden preventing relative motion between the tips and the hoops.

Figure 5:
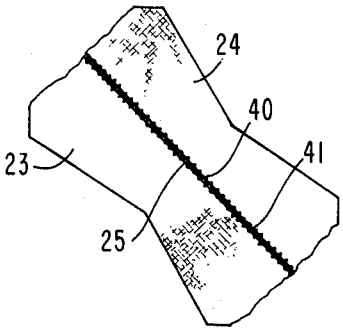
FIG. 5 is a fragmentary enlarged cross-sectional view taken along the line 5—5 of FIG. 4 and viewed in the direction of the arrows and showing two of the fabric wings attached together by a thread.

In order to secure fabrics 23 and 24 together and to maintain the fabrics within planes 30 and 31, it is necessary to sew together fabrics 23 and 24 at the adjacent centerlines 25 (FIG. 5). Thus, a single thread or line 40 (FIG. 5) may be used to secure together the centerline 41 of fabric 24 to the centerline 25 of fabric 23. Best results have been obtained by sewing the centerlines together prior to the mounting of the fabrics to the hoops. Thus, fabric 23 may be positioned atop fabric 24 with both fabrics being in a flat condition. The adjacent centerlines may then be sewn together. Excellent results have been obtained by starting at the midpoint of the centerlines and then sewing outwardly to one end and then repeating the process from the midpoint to the opposite end. For example, the sewing may be initiated at midpoint 42 (FIG. 7) with the centerlines then sewn together in a direction toward the top tip 43. The line may then be cut at the top tip 43 and sewing may be reinitiated at centerline 42 in a direction towards the bottom tip 44. Once the centerlines are sewn together, tips 43 of fabrics 23 and 24 are then tied by a string to the top intersection 45 (FIG. 1) of the two hoops. The bottom tips 44 of fabrics 23 and 24 are then attached by thread to the bottom intersection 46 of the two hoops. The remaining tips are then attached to the hoops as previously described.

Figure 4:
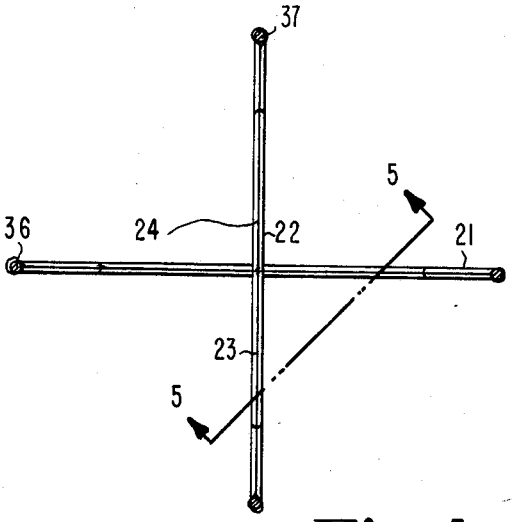
FIG. 4 is a rotated cross-sectional view taken along the line 4—4 of FIG. 1 and viewed in the direction of the arrows.
Figure 6:
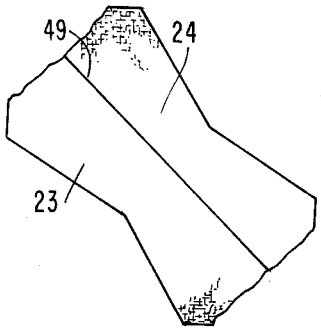
FIG. 6 is the same view as FIG. 5 only showing two adjacent wings weaved together as a unitary structure.

By tightly sewing together the centerlines of fabrics 23 and 24, the resulting structure will appear to be a unitary or single piece of fabric. Alternatively, the fabric structure may initially be woven, crocheted or sewn into a single structure without the necessity of sewing together two separate pieces of fabric. In such a case, the resulting unitary structure would still have four separate wing portions as depicted in FIG. 4 which are respectively attached to each half of hoops 21 and 22 in the same manner as previously described. Thus, in FIG. 6, fabrics 23 and 24 are shown as having an imaginary centerline 49 whereat the four wing portions are weaved together.

Figure 3:
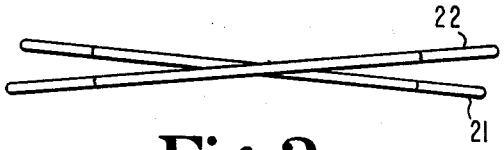
FIG. 3 is a top view of the ornament of FIG. 1 shown in the collapsed storage condition.

In one embodiment, the top end portions 45 of hoops 21 and 22 are welded together as are the two bottom portions 46. Thus, the ornament provides a non-collapsible rigid structure. Alternatively, the top ends 45 and bottom ends 46 are not welded together allowing the hoops to assume a relatively flat condition (FIG. 3) for storage purposes. In such a case, once the ornament is removed from storage, the hoops may be oriented to be perpendicular with a string then being attached to the top end 45 for the hanging of the ornament. The cloth fabrics 23 and 24 being sewn together at their centerlines will normally provide sufficient structure to maintain the perpendicularity of one hoop relative to the second hoop.

Figure 8:
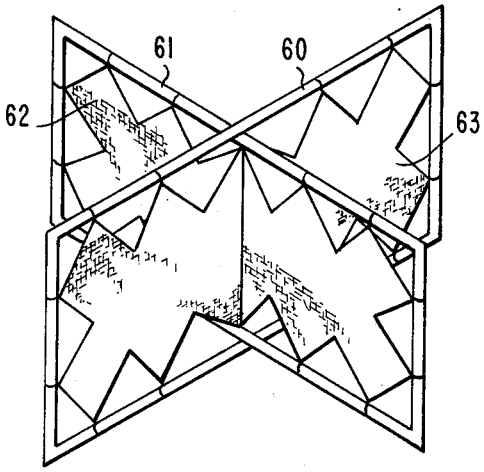
FIG. 8 is a perspective view of an alternate embodiment of the ornament of FIG. 1.
Figure 10:
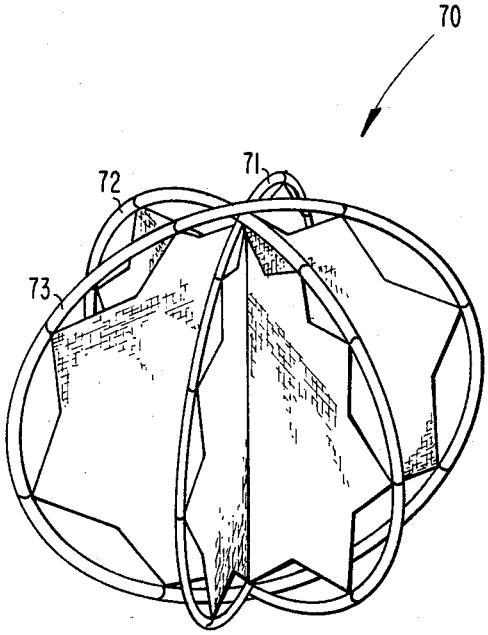
FIG. 10 is a perspective view of an additional embodiment showing three hoops.
Figure 9:
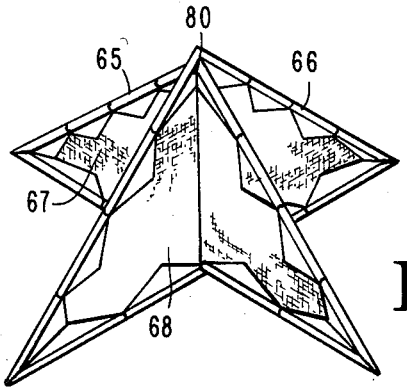
FIG. 9 is a perspective view of yet a further embodiment of the ornament of FIG. 1.

Many variations are contemplated and included in the present invention. For example, the hoops may be changed from a circular geometric configuration to any number of geometric configurations. In FIG. 8, hoops 60 and 61 have an external rectangular configuration with fabric 62 being joined to the outer periphery of the two left half portions as viewed in FIG. 8 of hoops 60 and 61 whereas fabric 63 is tied to the righthalf portions of hoops 60 and 61. Fabrics 62 and 63 are tied to the hoops in a manner identical to that previously described for the embodiment shown in FIG. 1. Likewise, the intersecting centerlines of fabric 62 and 63 are sewn together. Yet another embodiment is depicted in FIG. 9 wherein the hoops 65 and 66 are configured as triangular in lieu of the circular configuration of FIG. 1. Fabric 67is tied to the rearward projecting portions of hoops 65 and 66 whereas the edge portion of fabric 68 is tied to the forward projecting half portions of hoops 65 and 66 in a manner identical to that described for the embodiment of FIG. 1. Further, the number of hoops may be varied from two such as shown in FIG. 1 to three or more as illustrated in FIG. 10. For a three hoop configured ornament, three separate pieces of fabric are utilized in lieu of the two fabrics for ornaments 20. Thus, instead of bending a fabric through a 90° angle along its centerline as is the case for ornament 20 (FIG. 1) the single fabric is bent through an angle of 60° with the outer edges of the fabric then being tied to the respective hoops. For example, ornament 70 includes three hoops 71, 72 and 73 fixedly secured together at their top ends and bottom ends with the three hoops dividing the ornament into six separate angular segments of 60°. A single piece of fabric has its outer ends then tied to forward portion of hoop 71 as viewed in FIG. 10 and extends through the plane of hoop 71 to the intersection of the hoops whereat the fabric is bent through a 60° angle having its outer edges then tied to the right portion of hoop 72. A second fabric is then attached to hoops 71 and 73 with the outer edges of the fabric being first attached to the aft portion of hoop 73 extending inwardly through the plane of hoop 73 to the intersection point whereat the fabric is bent at a 60° angle and extending outwardly being tied to the aft portion of hoop 71. The third fabric is then attached to the two remaining half segments of hoops 72 and 73 all in a manner as described for the embodiment of FIG. 1. It can be appreciated that the number of hoops and fabrics can be increased to a number greater than that illustrated.

The ornament illustrated therefore includes a plurality of hoops each located within separate planes with each hoop arranged with respect to another hoop so that the planes intersect along a line extending interiorly across each of the hoops. The fabric includes a plurality of sheet configured wings which are joined together along the intersecting line of the planes and are attached at separate locations along the hoops so that each wing extends from a hoop to which it is attached to the intersecting line while being located in the respective plane of the attached hoop. The edges of each wing are tied to the hoops by string forming a knot limiting relative motion between the wings and the hoop at the location of the knots. A string 80 attached to the top ends of the hoops as depicted for the embodiment of FIG. 9 provides a hanging means attached to at least one of the hoops for the hanging of the ornament. The fabrics are attached to the hoops at diagonally opposite locations. For example, fabric 24 is attached to end 36 (FIG. 4) of hoop 21 at a diagonally opposite location of the attachment of fabric 23 to hoop 21.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An ornament comprising;

a plurality of hoops each located within separate planes with each hoop arranged with respect to another hoop so said planes intersect along a line extending interiorly across each of said hoops; and, fabric means having multiple sheet configured wings joined together along said line with said wings having outer edges attached at separate locations along said hoops and being arranged so each wing extends from a hoop to which it is attached to said line while being located in the respective plane of the hoop to which it is attached.

2. The ornament of claim 1 wherein:

said fabric means includes a plurality of fabric sheets with each sheet extending attachedly from a hoop inwardly to said line and then outwardly to another of said hoops with each of said sheets located in at least two of said planes, said sheets are fixedly connected together along said line to provide a unitary fabric structure.

3. The ornament of claim 2 wherein:

said edges of said wings are tied to said hoops by knots originally wet and further comprising a flowable substance placed on said knots and allowed to hardened securing said wings to said hoops and limiting relative motion between said wings and said hoops at the location of said knots.

4. The ornament of claim 3 wherein each hoop has the same geometrical configuration.

5. The ornament of claim 4 wherein each hoop is configured as circle.

6. The ornament of claim 4 and further comprising hanging means attached to one of said hoops for the hanging of said ornament.

7. The ornament of claim 6 wherein said hoops are welded together into a unitary structure.

8. The ornament of claim 6 wherein each of said hoops are movable with respect to each other of said hoops allowing said ornament to assume a flat condition when stored and an expanded condition when hung.

9. The ornament of claim 1 wherein:

said sings are woven together along said line in unitary fabric structure.

10. The ornament of claim 9 wherein said wings are sewn together along said line.

11. An ornament comprising:

a first hoop defining a first plane in which said hoop is located;

a second hoop defining a second plane in which said second hoop is located, said second hoop being arranged with respect to said first hoop so said second plane intersects said first plane along a line extending between different points on said second hoop;

a first fabric having a first outer edge attached to said first hoop and then extending in said first plane to said line whereat said first fabric extends into said second plane toward said second hoop having said outer edge attached thereto; and, additional fabric attached to said first fabric along said line and being located in said first plane having an additional edge attached to said first hoop at a location diagonally opposite from the attachment of said first fabric to said first hoop.

12. The ornament of claim 11 and further comprising: further fabric attached to said first fabric along said line and being located in said second plane having a further edge attached to said second hoop at a location diagonally opposite from the attachment of said first fabric to said second hoop.

13. The ornament of claim 12 wherein said additional fabric and said further fabric are a single sheet of fabric bent along said line to extend in said first plane and said second plane.

14. The ornament of claim 12 wherein said first and second hoop are fixedly attached together and have the same geometrical configuration.

15. The ornament of claim 12 wherein said first hoop is movable with respect to said second hoop allowing said first hoop to pivot relative to said second hoop for said ornament to assume a flat stored condition.

16. The ornament of claim 12 wherein said first and second hoop each have a circular configuration.

17. The ornament of claim 12 wherein said first and second hoop each have a rectangular configuration.

18. The ornament of claim 12 wherein said first and second hoop each have a triangular configuration.

19. The ornament of claim 12 wherein said first and second hoop are perpendicular when in a hanging position.

* * * * *